US008302593B2

(12) United States Patent
Cadima

(10) Patent No.: US 8,302,593 B2
(45) Date of Patent: Nov. 6, 2012

(54) GAS BURNER ASSEMBLY INCLUDING INNER AND OUTER BURNERS AND METHODS FOR IMPLEMENTING SAME

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 476 days.

(21) Appl. No.: 11/323,244

(22) Filed: Dec. 30, 2005

(65) Prior Publication Data

US 2007/0154858 A1 Jul. 5, 2007

(51) Int. Cl.
*F23D 14/06* (2006.01)
*A47J 37/00* (2006.01)
*F24C 3/00* (2006.01)

(52) U.S. Cl. ..... 126/39 R; 126/25 R; 126/39 E

(58) Field of Classification Search ..... 126/39 R, 126/39 E, 25 R
See application file for complete search history.

(56) References Cited

U.S. PATENT DOCUMENTS 2,530,183 A * 11/1950 Smallwood ..... 126/39 H
5,277,576 A 1/1994 Hartung et al.
5,488,942 A * 2/1996 Maughan ..... 126/39 E
5,842,849 A * 12/1998 Huang ..... 431/284
5,865,615 A * 2/1999 Simpson et al. ..... 431/266
5,961,311 A * 10/1999 Moore, Jr. ..... 431/6
6,089,219 A 7/2000 Kodera et al.
6,132,205 A * 10/2000 Harneit ..... 431/354
6,325,619 B2 * 12/2001 Dane ..... 431/284
6,817,353 B2 * 11/2004 Atkinson et al. ..... 126/39 E
6,889,685 B2 5/2005 Dane
6,935,328 B2 8/2005 Haynes et al.
7,017,572 B2 3/2006 Cadima
7,291,009 B2 * 11/2007 Kamal et al. ..... 431/284

* cited by examiner

*Primary Examiner* — Kenneth Rinehart
*Assistant Examiner* — William Corboy
(74) *Attorney, Agent, or Firm* — Global Patent Operation; Douglas D. Zhang

(57) ABSTRACT

A gas burner assembly for a cooking appliance that includes a cooktop surface includes a gas burner assembly having a first gas burner including a first burner body. The first burner configured to be mounted on, and contact, the cooktop surface, and provide a cooking flame. The gas burner assembly also includes a second gas burner including a second burner body. The second burner configured to be mounted on, and contact, the cooktop surface. The second burner also configured to be concentric with the first burner and separated from the first burner by a distance at all points along the burners. The second burner body including at least one air passage defined therethrough that is configured to allow air to flow through the second burner and to the cooking flame.

21 Claims, 4 Drawing Sheets

GAS BURNER ASSEMBLY INCLUDING INNER AND OUTER BURNERS AND METHODS FOR IMPLEMENTING SAME

BACKGROUND OF THE INVENTION

This invention relates generally to gas burners, and, more particularly, to methods and apparatus for gas burner assemblies including inner and outer burners.

For gas burners that are used as surface heating units in cooking appliances such as ranges and cooktops, having a high turndown ratio, which is a ratio of maximum output to minimum output, is desirable. For a given burner, the maximum output typically signifies the "power" or "speed" of the burner and the minimum output is related to the simmer capability of a burner. The maximum output is limited by system gas flow handling capabilities and safety considerations. The minimum output is limited by the ability of the burner to maintain a stable flame under transient pressure fluctuation conditions caused, for example, by air currents in the room, or sudden opening or closing of nearby cabinet doors or the oven door.

A vast majority of gas burners used in cooking applications are partially pre-mixed burners using both primary-air and secondary-air. Based on whether the primary-air is drawn from above the cooktop or below the cooktop, these burners are termed either top-breathers or bottom-breathers respectively. In bottom-breather burners, also referred to as sealed burners, there are no gaps around the burner to allow spills or air to get inside the cooktop. However, the sealed burners are sensitive to pressure fluctuations under the cooktop.

At least some known gas burner assemblies include an inner gas burner and an outer gas burner for collectively producing a plurality of rings of flame to heat a utensil supported thereon. Such gas burners are generally secured on a cooktop surface by screws, and it is difficult to clean the cooktop surface around and between the burners. The inner burner is surrounded by the outer burner, and secondary-air cannot flow through the outer flame ring to enter the inner flame ring, such that the maximum energy output of the inner burner is undesirably limited unless a gap is provided either through or under the other burner. This further increases the difficulty of cleaning the cooktop.

BRIEF DESCRIPTION OF THE INVENTION

In one aspect, a gas burner assembly is provided for a cooking appliance that includes a cooktop surface. The gas burner assembly includes a first gas burner including a first burner body. The first burner configured to be mounted on, and contact, the cooktop surface, and provide a cooking flame. The gas burner assembly also includes a second gas burner including a second burner body. The second burner configured to be mounted on, and contact, the cooktop surface and to be concentric with the first burner and separated from the first burner by a distance at all points along the burners. The second burner body including at least one air passage defined therethrough that is configured to allow air to flow through the second burner and to the cooking flame.

In another aspect, a cooking appliance is provided that includes a cooking panel having a cooktop surface and at least one gas burner assembly mounted on the cooking panel. The gas burner assembly including a first gas burner mounted on the cooktop surface and including a first burner body. The first gas burner configured to provide a cooking flame. The gas burner assembly also includes a second gas burner contacting the cooktop surface and surrounding the first burner. The second burner including a second burner body having at least one passage defined therethrough. The passage configured to allow air to flow through the second burner and to the cooking flame. At least one of the first burner and the second burner configured to be removed from the cooktop without removal of the other of the first burner and the second burner.

In another aspect, a method is provided for assembling a cooking appliance. The method includes providing a cooking panel having a cooktop surface and mounting a first gas burner on, and in contact with, the cooktop surface. The first burner including a first burner body and configured to provide a cooking flame. The method further including mounting a second gas burner on, and in contact with, the cooktop surface such that the second gas burner surrounds the first burner and is separated from the first burner by a distance at all points along the burners. The second burner including a second burner body. The method further including defining at least one passage through the second burner body. The passage configured to allow air to flow through the second burner and to the cooking flame.

In another aspect, a cooking apparatus is provide that includes a cooktop surface and at least one gas burner assembly mounted on the cooktop surface. The gas burner assembly further including a gas simmer burner mounted on, and in contact with, the cooktop surface. The simmer burner includes a simmer burner body and it is configured to provide a cooking flame. The gas burner assembly further includes a second gas burner mounted on, and in contact with, the cooktop surface and concentric with the simmer burner. The second burner comprising a second burner body having at least one passage defined therethrough. The passage configured to allow air to flow through the second burner and to the cooking flame. Wherein the second burner configured to be removed from the cooktop surface without removal of the first burner.

DETAILED DESCRIPTION OF THE INVENTION

Figure 1:
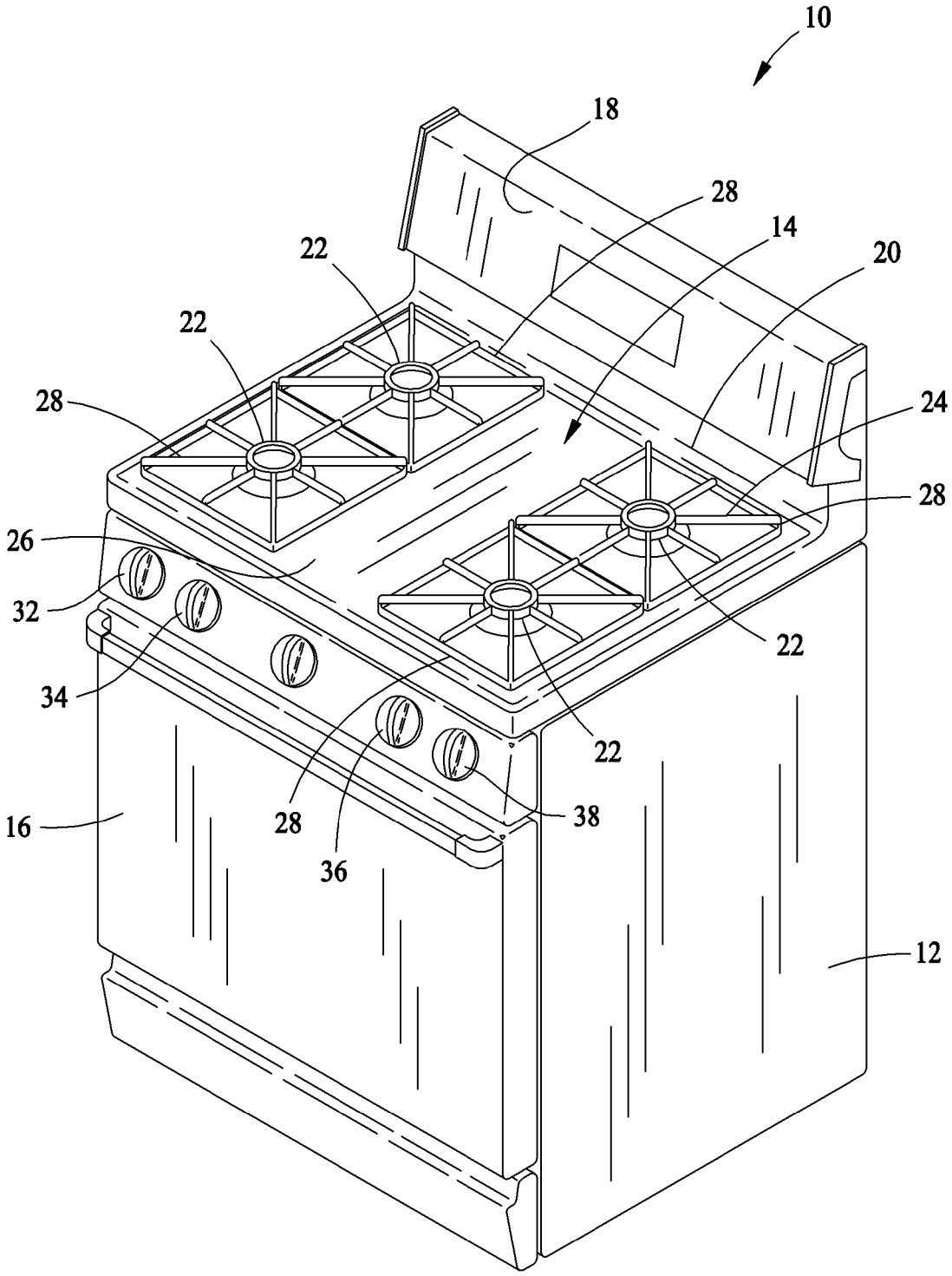
FIG. 1 illustrates an embodiment of an exemplary free-standing gas range.

FIG. 1 illustrates an exemplary free-standing gas range 10 in which the herein described apparatus and methods may be practiced. Range 10 includes an outer body or cabinet 12 that incorporates a generally rectangular cooktop 14. An oven, not shown, is positioned below cooktop 14 and has a front-opening access door 16. A range backsplash 18 extends upward from a rear edge 20 of cooktop 14 and contains various control selectors (not shown) for selecting operative features of heating elements for cooktop 14 and the oven.

Cooktop 14 includes four gas fueled burner assemblies 22 which are positioned in spaced apart pairs positioned adjacent each side of cooktop 14. Each burner assembly 22 extends upward through an opening in cooktop 14, and a grate 28 is positioned over each burner assembly 22. Each grate 28 includes a horizontally extending support structure thereon for supporting cooking vessels.

Cooktop 14 also includes control devices, such as, knobs 32, 34, 36, and 38 that are manipulated by a user to adjust the setting of a corresponding gas valve (not shown) to control the amount of heat output from the corresponding one of burner assemblies 22. For example, rotating knob 32 in one direction switches the valve from off to the full on position. Continued rotation gradually moves the valve from the full open position to the minimum setting position. Accordingly, the user may adjust the heat output of the corresponding burner to the desired level.

It is contemplated that the herein described apparatus and methods are applicable, not only to cooktops which form the upper portion of a range, such as range 10, but to other forms of cooktops as well, such as, but not limited to, cooktops that are mounted to a kitchen counter. Therefore, range 10 is provided by way of illustration rather than limitation, and accordingly there is no intention to limit application of the herein described apparatus and methods to any particular appliance or cooktop, such as range 10 or cooktop 14. It is also to be understood that there can be any other number of burner assemblies or any combination of burner assemblies and other type of cooking surfaces, such as, grills and hot plates, included in cooktop 14.

Figure 2:
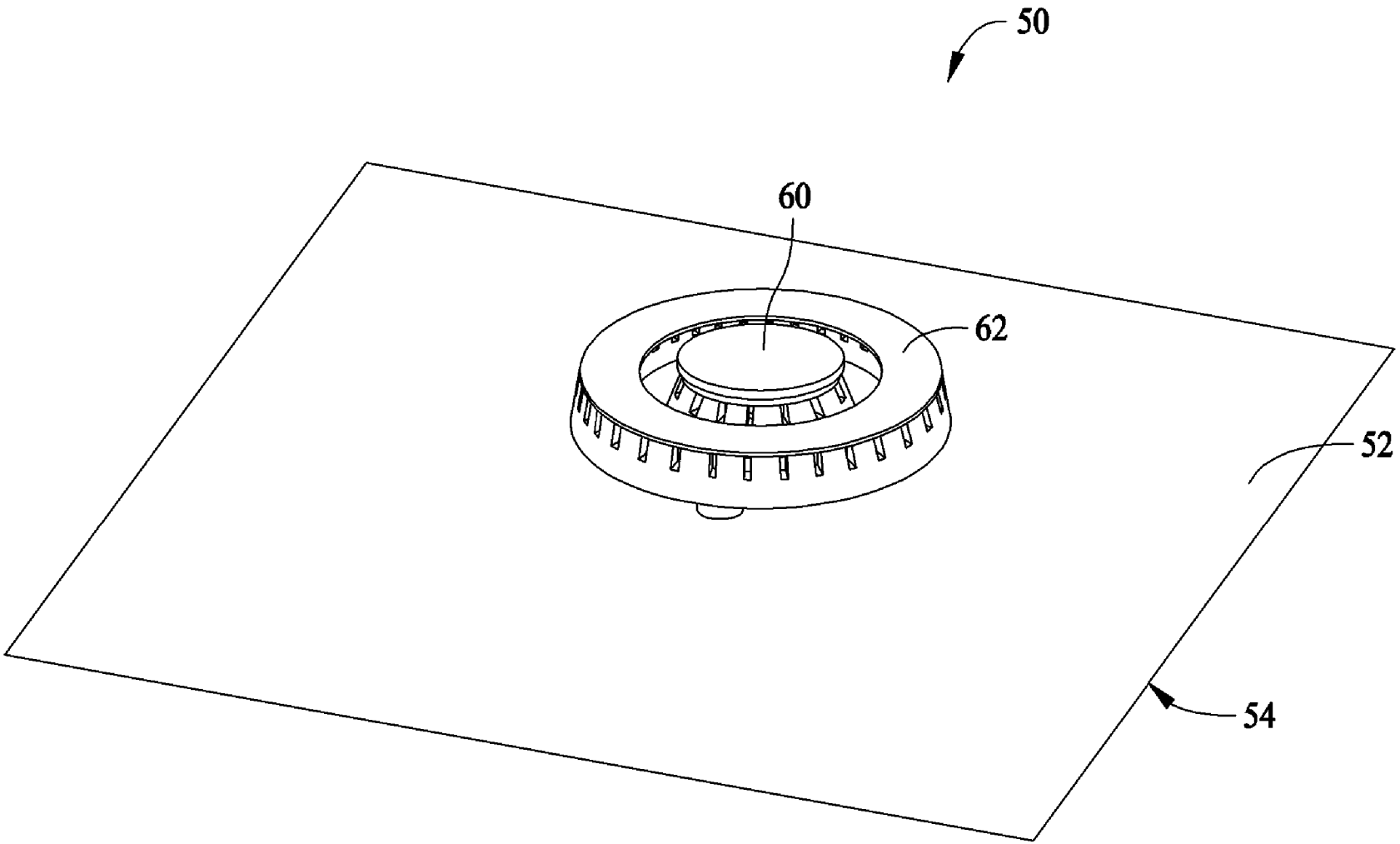
FIG. 2 is an exemplary burner assembly applicable to the gas range shown in FIG. 1.
Figure 3:
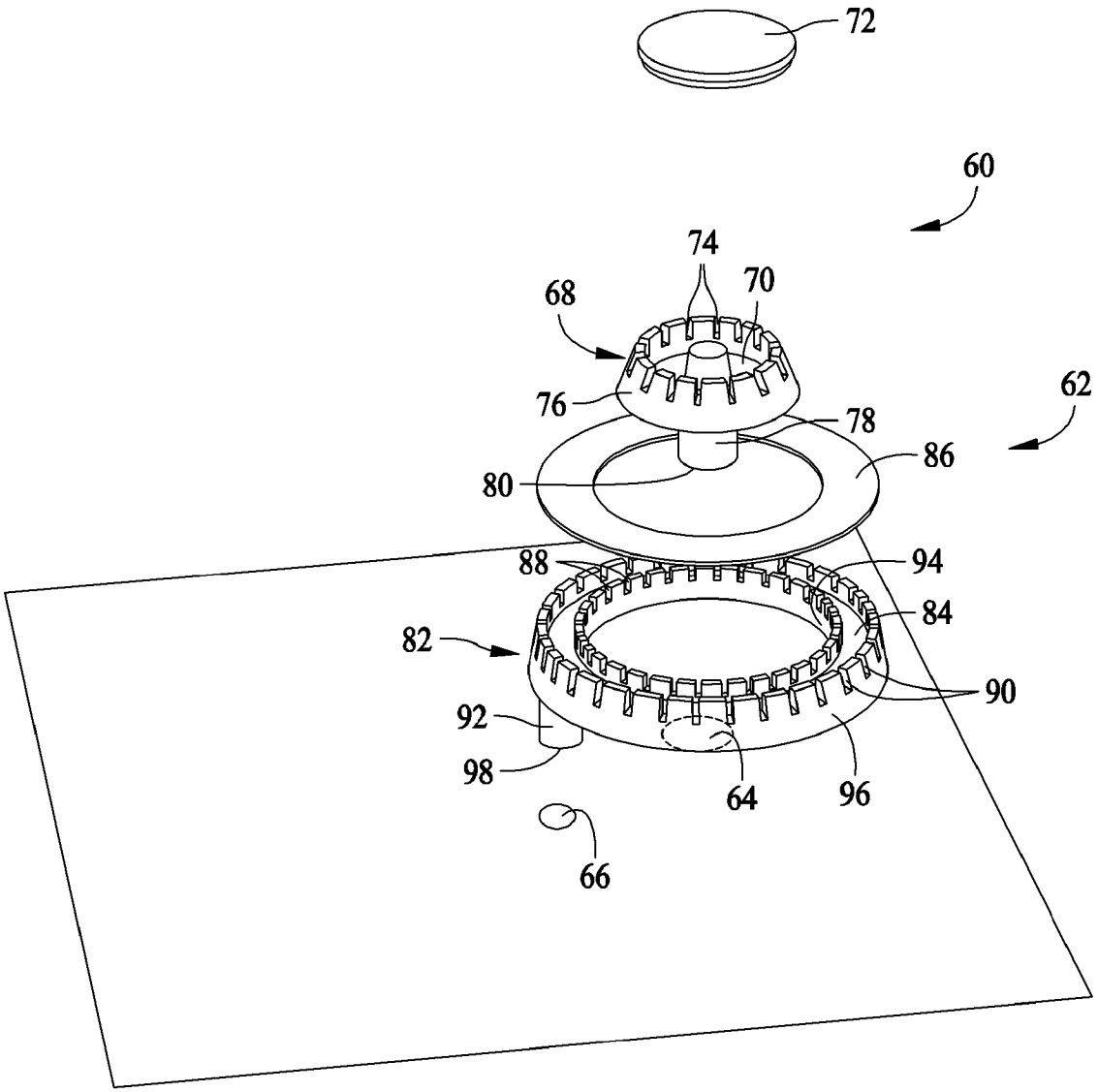
FIG. 3 is an exploded view of the burner assembly shown in FIG. 2.

FIG. 2 is an exemplary burner assembly 50 applicable to gas range 10 shown in FIG. 1, and FIG. 3 is an exploded view of burner assembly 50 shown in FIG. 2. Burner assembly 50 is mounted on a cooktop surface 52 of a cooktop 54, and includes a central simmer burner 60, and an outer gas burner 62 concentric with simmer burner 60. In the exemplary embodiment, cooktop 54 is fabricated from one of steel and glass, and cooktop surface 52 includes a first and a second mounting opening 64, 66 for mounting simmer burner 60 and outer burner 62 thereon, respectively. Alternatively, cooktop 54 is made of other suitable materials.

Simmer burner 60 includes a simmer burner body 68 having a simmer burner chamber 70 defined therein, a central cap 72 for covering simmer burner body 68, a plurality of ports 74 defined on an outer circumferential surface 76 of simmer burner body 68, and a venturi 78 extending downward from simmer burner body 68. Central cap 72 is substantially circular in shape, and is removably mounted on simmer burner body 68 for enclosing simmer burner chamber 70 therein. Removal of cap 72 also enables an operator to clean simmer burner chamber 70. Ports 74 are in flow communication with simmer burner chamber 70, and are shown in the form of slots in FIG. 3. In alternative embodiments, ports 74 have shapes other than slots. Venturi 78 is in flow communication with simmer burner chamber 70, and is inserted into mounting opening 64. Venturi 78 includes a gas inlet 80 positioned beneath cooktop 54 for receiving gas from a gas supply (not shown) and channeling the gas into chamber 70.

Outer gas burner 62 is separate from simmer burner 60 and surrounds simmer burner 60 therein. Outer burner 62 includes an outer burner body 82 having a ring-shaped outer burner chamber 84 defined therein, an outer cap 86 for covering outer burner body 82, a first group of ports 88 and a second group of ports 90 defined thereon. A venturi 92 extends downward from outer burner body 82. In alternative embodiments, at least one of burner bodies 82, 84 have a shape other than ring-shaped.

Outer cap 86 is substantially ring-shaped, and is removably mounted on outer burner body 82 for enclosing outer burner chamber 84 therein. In alternative embodiments, outer cap 86 is other than ring shaped. First group of ports 88 are located on an inner circumferential surface 94 of outer burner body 82, and second group of ports 90 are located on an outer circumferential surface 96 of outer burner body 82. Both first group of ports 88 and second group of ports 90 are in flow communication with outer burner chamber 84, and are illustrated as slots in FIG. 3. However, in alternative embodiments, ports 88, 90 have other shapes. Venturi 92 is also in flow communication with outer burner chamber 84, and is inserted into mounting opening 66. Venturi 92 includes a gas inlet 98 positioned beneath cooktop 54 for receiving the gas from the gas supply and channeling the gas into chamber 84.

Figure 4:
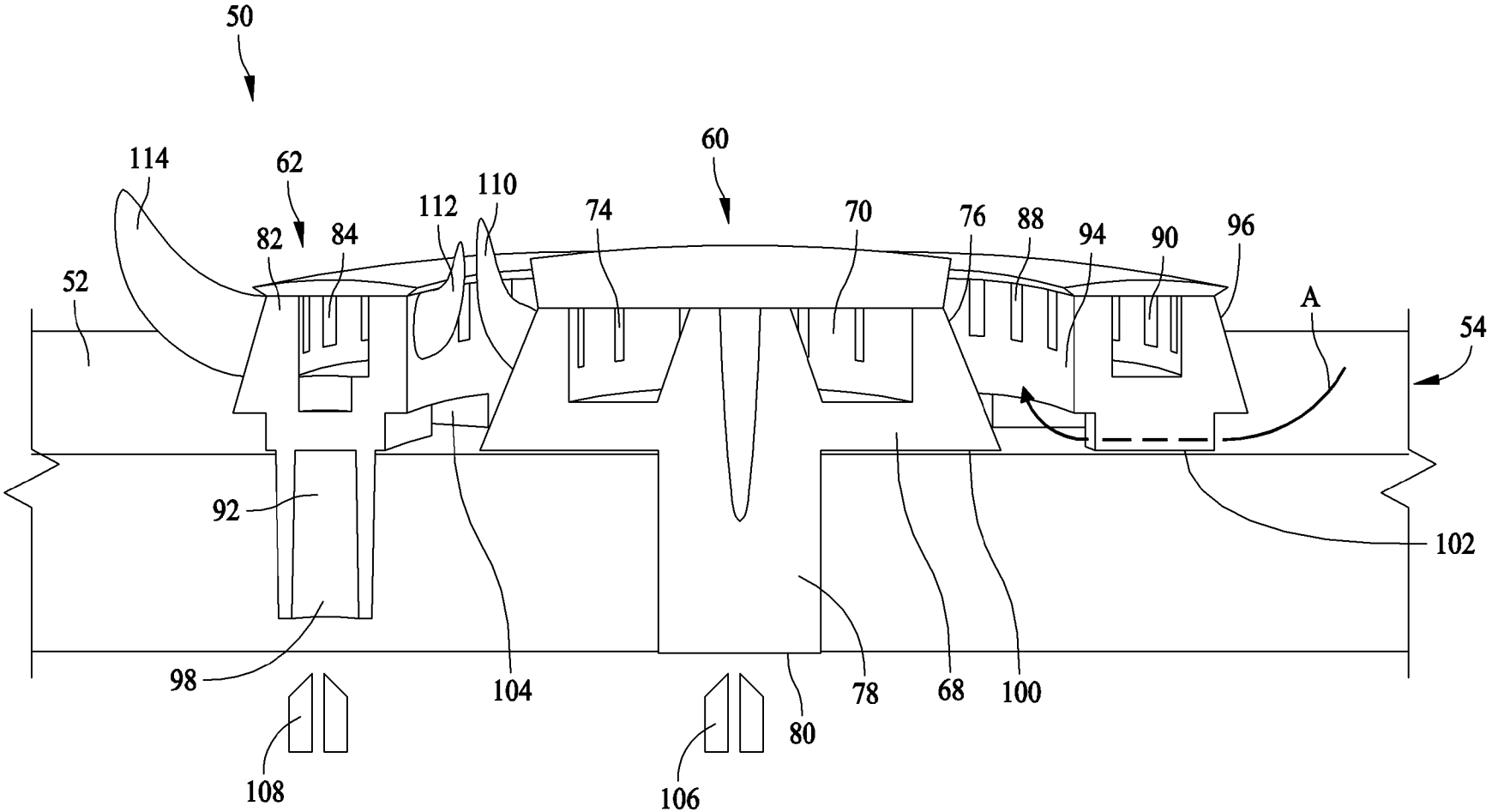
FIG. 4 is a cross sectional view of the burner assembly shown in FIG. 2.

FIG. 4 is a cross sectional view of burner assembly 50 shown in FIG. 2. In the exemplary embodiment, both simmer burner 60 and outer burner 62 are mounted on cooktop 54 without using screws. As such, simmer burner 60 and outer burner 62 are easily removed from cooktop by an operator's hands without using additional tools. This easy removal facilitates conveniently cleaning cooktop surface 52 beneath and around burners 60, 62. In a further exemplary embodiment, simmer burner 60 and outer burner 62 are not fastened onto cooktop 54 to facilitate even easier removal of burners 60, 62 from cooktop 54. In another embodiment, simmer burner 60 is fastened, or sealed, to cooktop 54 and outer burner 62 is not mounted to cooktop 54 with fasteners.

In the exemplary embodiment, simmer burner 60 is a sealed burner, and simmer burner body 68 includes a continuous and flat bottom surface 100 that contacts cooktop surface 52. Surface 100 thus forms a substantially annulus seal surrounding mounting hole 64. This seal restricts liquid and/or spillage collected on cooktop surface 52 from flowing therethrough and into an interior of cooktop 54 through mounting hole 64. In alternative embodiments, simmer burner body 68 has other shapes and includes other structures known in the art to form a seal between the simmer burner 60 and cooktop surface 52.

Outer burner 62 includes a bottom surface 102 and a plurality of passages 104 circumferentially defined on bottom surface 102. Passages 104 are illustrated as slots in FIG. 4, and are positioned above cooktop surface 52. In alternative embodiments, the number of passages 104 is varied, and passage 104 has other shapes and is defined through outer burner body 82 at other positions for allowing air flow therethrough.

The gas supply (not shown) includes a plurality of gas conduits (not shown), a first orifice 106 and a second orifice 108 coupled in flow communication with the gas conduits and positioned beneath cooktop surface 52. Orifices 106, 108 face gas inlets 80, 98 of venturis 78, 92 and supply gas into burner chambers 70, 84, respectively. In alternative embodiments, gas is fed to each burner chamber 70, 84 via multiple orifices.

In operation, simmer burner chamber 70 receives the primary-air from an underside of cooktop surface 52. The primary-air beneath cooktop surface 52 mixes with the gas supplied via orifice 106 to form an air-gas mixture. The air-gas mixture flows through venturi 78 to simmer burner chamber 70, and flows out from ports 74 defined on outer circumferential surface 76 of simmer burner body 68. The air-gas mixture is ignited by an ignition source (not shown), such as a spark ignition electrode or a hot surface igniter, to generate an inner ring of flame 110.

The primary-air beneath cooktop surface 52 also mixes with the gas supplied via orifice 106 to form an air-gas mixture. The air-gas mixture flows through venturi 92 to outer burner chamber 84. The air-gas mixture also flows out from first and second group of ports 88, 90 defined on inner and outer circumferential surfaces 94, 96 of outer burner body 82. The air-gas mixture exiting ports 88 is ignited to generate a middle ring of flame 112, and the air-gas mixture exiting ports 90 is ignited to generate an outer ring of flame 114.

Secondary-air above cooktop 54 flows towards outer flame ring 114 to complete combustion. The secondary-air above cooktop 54 also flows through passages 104 along direction A shown in FIG. 4, and then to inner and middle flame rings 110, 112. The secondary-air flows below outer flame ring 114, and into the interior of outer burner 62 to complete combustion of inner and middle flame rings 110, 112.

In the exemplary embodiment, outer burner 62 has a maximum energy output larger than a maximum energy output of simmer burner 60. In addition, both simmer burner 60 and outer burner 62 are operable simultaneously when burner assembly 50 is operated at levels above a simmer range. Alternatively, only one of simmer burner 60 and outer burner 62 is operated during a particular cooking event such as, for example, when burner assembly 50 is operated within the simmer range. Specifically, when knob 32 (shown in FIG. 1) is moved to a position within the simmer range, outer burner 62 is de-energized, and simmer burner 60 is energized to a level indicated by a position of knob 32. When knob 32 is turned from a low level to a high level, the energy output of simmer burner 60 increases to a higher rate, and outer burner 62 is ignited when knob 32 is turned to a level above the simmer range. When knob 32 is turned to an "off" position, both burners 60, 62 are de-energized.

By allowing the secondary-air to flow through the underside of the outer burner and to the central burner, the central burner is able to reach a much higher energy output. In addition, the central and outer burners are removably mounted on the cooktop surface, which facilitates cleaning the cooktop surface beneath and around the burners.

While the invention has been described in terms of various specific embodiments, those skilled in the art will recognize that the invention can be practiced with modification within the spirit and scope of the claims.

What is claimed is:

1. A gas burner assembly for a cooking appliance including a substantially planar cooktop surface, said gas burner assembly comprising:

a first burner assembly comprising a first burner body comprising a substantially flat bottom surface configured to be mounted directly on, and contact the substantially planar cooktop surface and form a substantially annulus seal therebetween, the first burner assembly being configured to provide an inner ring cooking flame, said first burner assembly comprising a central cap removably coupled to said first burner body, said first burner body and said central cap defining a burner chamber within said first burner assembly, said burner chamber being configured to receive primary-air from below the cooktop surface;

a second burner assembly configured to be mounted on, and contact the substantially planar cooktop surface, and provide an outer ring cooking flame, said second burner assembly being configured to be concentric with said first burner assembly and separated from said first burner assembly by a distance at all points along said first and second burner assemblies, the second burner assembly comprising a bottom surface and a plurality of passages circumferentially defined in the bottom surface, the plurality of passages being positioned above the substantially planar cooktop surface;

at least one of said first burner assembly and said second burner assembly being independently removable from the cooktop surface without using a tool, an interior of said second burner assembly being configured to receive secondary-air, the secondary-air flowing from below the outer ring cooking flame into the interior of the second burner assembly to facilitate combustion of the inner ring cooking flame; and said first burner assembly being configured to operate, independent of said second burner assembly, at or below a first level, and said first burner assembly and said second burner assembly being configured to operate simultaneously at or above the first level.

2. A gas burner assembly in accordance with claim 1 wherein said second burner assembly is configured to be removed from the cooktop surface without removal of said first burner assembly.

3. A gas burner assembly in accordance with claim 1 wherein said first burner assembly is configured to be removed from the cooktop surface without removal of said second burner assembly.

4. A gas burner assembly in accordance with claim 1 wherein at least one air passage is positioned at least partially above the cooktop surface.

5. A gas burner assembly in accordance with claim 1 wherein said second burner assembly is substantially annulus in shape, the at least one air passage comprises a plurality of air passages circumferentially arranged on said second burner assembly.

6. A gas burner assembly in accordance with claim 1 wherein said first burner assembly is configured to restrict liquid on the cooktop surface from flowing into an interior of the cooking appliance.

7. A gas burner assembly in accordance with claim 1 wherein said first burner assembly comprises a gas inlet positioned below the cooktop surface, said gas inlet configured to receive a gas and air mixture into said first burner assembly.

8. A gas burner assembly in accordance with claim 1 wherein said second burner assembly does not contact said first burner assembly.

9. A cooking appliance comprising:

a cooktop comprising a substantially planar cooktop surface; and a gas burner assembly mounted on said cooktop, said gas burner assembly comprising:

a first burner assembly mounted directly on said substantially planar cooktop surface, said first burner assembly being configured to provide an inner ring cooking flame, said first burner assembly comprising a first burner body comprising a substantially flat bottom and a central cap removably coupled to said first burner body, the substantially flat bottom and substantially planar cooktop surface forming a substantially annulus seal therebetween; said first burner body and said central cap defining a burner chamber within said first burner assembly, said burner chamber being configured to receive primary-air from below the cooktop surface;

a second burner assembly contacting said substantially planar cooktop surface and surrounding said first burner assembly, said second burner assembly being configured to provide an outer ring cooking flame, the second burner assembly comprising a bottom surface and a plurality of passages circumferentially defined in the bottom surface, the plurality of passages being positioned above the cooktop surface;

wherein one of said first burner assembly and said second burner assembly is configured to be removed from the cooktop without removal of the other of said first burner assembly and said second burner assembly, at least one of said first burner assembly and said second burner assembly being independently removable from said cooktop surface by an operator's hand without using a tool, an interior of said second burner assembly being configured to receive secondary-air, the secondary-air flowing from below the outer ring cooking flame into the interior of the second burner assembly to facilitate combustion of the inner ring cooking flame; and wherein said first burner assembly is configured to operate, independent of said second burner assembly, at or below a first level, and said first burner assembly and said second burner assembly being configured to operate simultaneously at or above the first level.

10. A cooking appliance in accordance with claim 9 wherein said second burner assembly does not contact said first burner assembly when each are positioned on said cooktop surface.

11. A cooking appliance in accordance with claim 9 wherein the at least one passage is positioned at least partially above said cooktop surface.

12. A cooking appliance in accordance with claim 11 wherein said second burner assembly is substantially ring-shaped and the at least one passage comprises a plurality of passages circumferentially arranged on said second burner assembly.

13. A cooking appliance in accordance with claim 9 wherein said first burner assembly is configured to contact said cooktop surface to form a substantially annulus seal restricting liquid flow therethrough.

14. A cooking appliance in accordance with claim 9 wherein said first burner assembly comprises a gas inlet positioned below said cooktop surface, said gas inlet configured to allow a gas and air mixture into said first burner assembly.

15. A cooking appliance in accordance with claim 9 wherein said second burner assembly is separated from said first burner assembly by a distance at all points along said first and second burner assemblies.

16. A method for assembling a cooking appliance, said method comprising:

providing a cooktop comprising a substantially planar cooktop surface;

mounting a substantially flat bottom surface of a first burner assembly on, and in direct contact with the substantially planar cooktop surface to form a substantially annulus seal therebetween, the first burner assembly being configured to provide an inner ring cooking flame, the first burner assembly comprising a first burner body and a central cap removably coupled to the first burner body, the first burner body and the central cap defining a burner chamber within the first burner assembly, wherein the burner chamber is configured to receive primary-air from below the cooktop surface;

mourning a second burner assembly on, and in contact with the substantially planar cooktop surface such that the second burner assembly surrounds the first burner assembly and is separated from the first burner assembly by a distance at all points along the first and second burner assemblies, the second burner assembly comprising a bottom surface and a plurality of passages circumferentially defined in the bottom surface, the plurality of passages being positioned above the substantially planar cooktop surface;

the second burner assembly being configured to provide an outer cooking flame, at least one of the first burner assembly and the second burner assembly being independently removable from the cooktop surface without using a tool, an interior of the second burner assembly being configured to receive secondary-air, the secondary-air flowing from below the outer ring cooking flame into the interior of the second burner assembly to facilitate combustion of the inner ring cooking flame;

configuring the first burner assembly to operate independent of the second burner assembly, at or below a first level; and configuring the second burner assembly to operate simultaneously with the first burner assembly at or above the first level.

17. A cooking appliance in accordance with claim 16 further comprising mounting the first burner assembly such that the first burner assembly restricts liquid from flowing into an interior of the cooking appliance.

18. A cooking appliance in accordance with claim 16 further comprising mounting the first burner assembly such that the first burner assembly includes a gas inlet positioned below the cooktop surface, the gas inlet configured to allow a gas and air mixture into the first burner assembly.

19. A cooking apparatus comprising:

a substantially planar cooktop surface; and a gas burner assembly mounted on said cooktop surface, said gas burner assembly comprising:

a simmer burner assembly comprising a substantially flat bottom mounted on, and in direct contact with said cooktop surface to form a substantially annulus seal therebetween, said simmer burner assembly being configured to provide an inner ring cooking flame, said simmer burner assembly comprising a simmer burner body and a central cap removably coupled to said simmer burner body, said simmer burner body and said central cap defining a simmer burner chamber within said simmer burner assembly, said simmer burner chamber being configured to receive primary-air from below the cooktop surface;

a second burner assembly mounted on, and in contact with said substantially planar cooktop surface and concentric with said simmer burner assembly, the second burner assembly comprising a bottom surface and a plurality of passages circumferentially defined in the bottom surface, the plurality of passages being positioned above the substantially planar cooktop surface;

said second burner assembly being configured to and provide an outer ring cooking flame, at least one of said simmer burner assembly and said second burner assembly being configured to be independently removed from said cooktop surface without using a tool, an interior of said second burner assembly being configured to receive secondary-air, the secondary-air flowing from below the outer ring cooking flame into the interior of the second burner assembly to facilitate combustion of the inner ring cooking flame; and said simmer burner assembly being configured to operate, independent of said second burner assembly, at or below a first level, and said simmer burner assembly and said second burner assembly being configured to operate simultaneously at or above the first level.

20. A cooking apparatus in accordance with claim 19 wherein said second burner assembly is substantially annulus in shape, the at least one passage comprises a plurality of passages arranged along said second burner assembly.

21. A cooking apparatus in accordance with claim 19 wherein said simmer burner assembly comprises a gas inlet positioned below said cooktop surface, said gas inlet configured to receive a gas and air mixture into said simmer burner assembly.

* * * * *